US010605214B2

(12) United States Patent
Krause et al.

(10) Patent No.: US 10,605,214 B2
(45) Date of Patent: Mar. 31, 2020

(54) FUEL PUMP HAVING IMPROVED PUMPING BEHAVIOR

(71) Applicant: Robert Bosch GmbH, Stuttgart (DE)

(72) Inventors: Andreas Krause, Unterriexingen (DE); Juergen Koreck, Ludwigsburg (DE); Siamend Flo, Schwieberdingen (DE); Walter Maeurer, Korntal-Muenchingen (DE)

(73) Assignee: Robert Bosch GmbH, Stuttgart (DE)

( * ) Notice: Subject to any disclaimer, the term of this patent is extended or adjusted under 35 U.S.C. 154(b) by 260 days.

(21) Appl. No.: 15/525,946

(22) PCT Filed: Sep. 2, 2015

(86) PCT No.: PCT/EP2015/070071
§ 371 (c)(1),
(2) Date: May 10, 2017

(87) PCT Pub. No.: WO2016/074814
PCT Pub. Date: May 19, 2016

(65) Prior Publication Data

US 2017/0321643 A1 Nov. 9, 2017

(30) Foreign Application Priority Data

Nov. 13, 2014 (DE) ..... 10 2014 223 198

(51) Int. Cl.
*F02M 59/02* (2006.01)
*F02M 51/04* (2006.01)
(Continued)

(52) U.S. Cl.
CPC ..... *F02M 59/025* (2013.01); *F02M 51/04* (2013.01); *F02M 59/464* (2013.01);
(Continued)

(58) Field of Classification Search
CPC .. F02M 59/025; F02M 63/0054; F02M 69/02; F02M 51/04; F02M 63/0077;
(Continued)

(56) References Cited

U.S. PATENT DOCUMENTS 6,199,533 B1 * 3/2001 Morris ..... F02M 59/46 123/299

FOREIGN PATENT DOCUMENTS

DE 1911534 9/1970
DE 1911534 A1 9/1970
(Continued)

OTHER PUBLICATIONS

International Search Report for Application No. PCT/EP2015/070071 dated Nov. 3, 2015 (English Translation, 3 pages).

*Primary Examiner* — Charles G Freay
*Assistant Examiner* — Lilya Pekarskaya
(74) *Attorney, Agent, or Firm* — Michael Best & Friedrich LLP

(57) ABSTRACT

The present invention relates to a fuel pump for pumping fuel, comprising a piston (2) and a diaphragm seal element (3), which seals on an inner annular seal seat (4) and an outer annular seal seat (5), wherein the following equation is satisfied: $(Ra^2-ra^2)/(ri+L)^2=ra/ri$, where ri is the inner radius of the inner seal seat (4), ra is the inner radius of the outer seal seat (5), Ra is the outer diameter of the piston (2) and L is a difference between an outer radius (Ria) of the inner seal seat (4) and the inner radius (ri) of the inner seal seat (4). The invention further relates to a method for operating a fuel pump.

11 Claims, 2 Drawing Sheets

(51) Int. Cl.

| | |
|---|---|
| ***F02M 63/00*** | (2006.01) |
| ***F02M 69/02*** | (2006.01) |
| ***F02M 59/46*** | (2006.01) |
| ***F04B 53/10*** | (2006.01) |
| ***F04B 53/14*** | (2006.01) |
| *F02M 37/04* | (2006.01) |

(52) U.S. Cl.
CPC .... *F02M 63/0054* (2013.01); *F02M 63/0077* (2013.01); *F02M 69/02* (2013.01); *F04B 53/1032* (2013.01); *F04B 53/1067* (2013.01); *F04B 53/143* (2013.01); *F02M 37/04* (2013.01); *F02M 2200/04* (2013.01); *F02M 2200/26* (2013.01)

(58) Field of Classification Search
CPC . F02M 59/464; F04B 53/143; F04B 53/1032; F04B 53/1067
See application file for complete search history.

(56) References Cited

FOREIGN PATENT DOCUMENTS

| | | | | |
|---|---|---|---|---|
| DE | 102012211106 | | 1/2014 | |
| EP | 2198149 | | 6/2010 | |
| EP | 2414676 | | 2/2012 | |
| EP | 2414676 | A1 * | 2/2012 | ..... F02M 59/464 |
| GB | 2452954 | A | 3/2009 | |
| JP | 56133982 | | 10/1981 | |
| JP | 57171 | | 1/1982 | |
| JP | 2010084674 | A | 4/2010 | |

* cited by examiner

FUEL PUMP HAVING IMPROVED PUMPING BEHAVIOR

BACKGROUND OF THE INVENTION

The present invention relates to a fuel pump for delivering fuel, which has improved pumping behavior, especially in the case of hot fuel.

Fuel pumps are known in various embodiments from the prior art. One set of problems with fuel pumps arises particularly in the case of hot fuel, when a pressure drop occurs during the intake process, with the result that gases are released from the hot fuel and the released gases can enter the delivery chamber of the fuel pump. This can lead to a significant drop in the delivery characteristic of the fuel pump. Moreover, the nonuniform pressure drop during the intake process can also lead to increased frictional losses, additionally intensifying the pressure drop.

SUMMARY OF THE INVENTION

In contrast, the fuel pump according to the invention has the advantage that an improved delivery characteristic is possible, especially in the case of hot fuel. In this case, according to the invention, a lower pressure drop is achieved, on the one hand, and a more uniform pressure drop in the piston chamber during the intake process is also made possible, on the other hand. In particular, the behavior of the fuel pump in the case of hot fuel is thereby significantly improved since gas release can be avoided. In this way, a delivery characteristic can also remain as uniform as possible at different fuel temperatures. According to the invention, this is achieved by virtue of the fact that the fuel pump comprises a piston and a diaphragm seal element. Here, the diaphragm seal element seals on an inner annular seal seat and an outer annular seal seat. In this case, the following equation is satisfied:

$$Ra^2-ra^2/(ri+L)^2=ra/ri.$$

Here, ri is the inner radius of the inner seal seat, ra is the inner radius of the outer seal seat, Ra is the radius of the piston and L is a difference between an outer radius Ria of the inner seal seat and the radius ri of the inner seal seat. This ensures that the flow rates during the opening process are of equal magnitude at the inner seal seat and the outer seal seat as the fuel flows in, and therefore the pressure conditions do not differ at the inner and outer seal seats, with the result that no release of gases from the fuel takes place.

For a particularly compact construction of the fuel pump, the diaphragm seal element preferably has a central circular delivery opening. The delivery opening is preferably formed centrally in the diaphragm seal element. It is thereby possible to achieve delivery without major losses.

As a further preference, the diaphragm seal element comprises an outer retaining region and an inner sealing region, which are connected to one another by connecting arms, in particular spring arms. In this case, the diaphragm seal element is fixed in the outer retaining region, which is preferably annular. The sealing region comprises the inner and outer seal seats.

According to another preferred embodiment of the present invention, a diameter of a delivery passage which is arranged immediately after the diaphragm seal element in the delivery direction and into which the fuel pump delivers is greater than a diameter of the central delivery opening. As a particular preference, an inner radius ri of the inner seal seat is equal here to the radius of the delivery passage. In other words, the outer circumference of the delivery passage preferably defines the inner radius of the inner seal seat.

According to another preferred embodiment of the present invention, the fuel pump furthermore comprises a feed region having an annular cross section. It is thereby possible to ensure a relatively large feed region, with the result that a stroke of the piston of the fuel pump for complete filling during the intake process can remain relatively small.

Here, an area of the annular cross section of the feed region is preferably larger than a sum of the areas of the inner and outer seal seats. This ensures that a pressure drop in the fuel during the intake process as it flows over the inner and outer seal seats is as far as possible the same or can be minimized at both seal seats.

The invention furthermore relates to a method for operating a fuel pump having a piston and a diaphragm seal element having an inner annular seal seat and an outer annular seal seat. Here, the method comprises the step of drawing in fuel in such a way that, when the diaphragm seal element is open, a flow rate of the fuel at the inner seal seat is equal to a flow rate of the fuel at the outer seal seat. As a result, a pressure drop is reduced, on the one hand, and there is no pressure difference in the region of the inner and outer seal seats, on the other hand, and therefore a problem with the release of gases, even with a hot fuel, does not occur.

As a particular preference, the method according to the invention is furthermore designed in such a way that the diaphragm seal element is set up to adhere to the piston of the fuel pump during the opening process. A maximum opening cross section is thereby achieved.

As a further preference, the diaphragm seal element rises simultaneously from the inner seal and outer seal seats during the intake process.

BRIEF DESCRIPTION OF THE DRAWINGS

A preferred illustrative embodiment of the invention is described in detail below with reference to the accompanying drawing. In the drawing.

DETAILED DESCRIPTION

A fuel pump 1 according to a preferred illustrative embodiment of the invention is described in detail below with reference to FIGS. 1 to 3.

The fuel pump 1 comprises a piston 2, which can be moved backward and forward in a cylinder 8. Reference sign 9 denotes a return element, in this illustrative embodiment a cylindrical spring.

Figure 2:
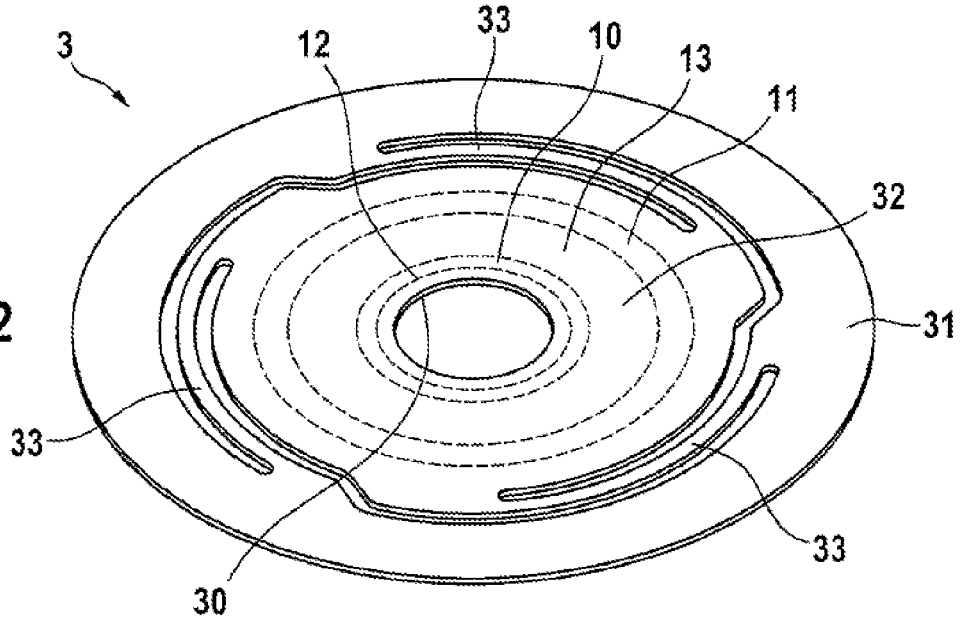
FIG. 2 shows a schematic perspective view of a diaphragm seal element from FIG. 1.
Figure 3:
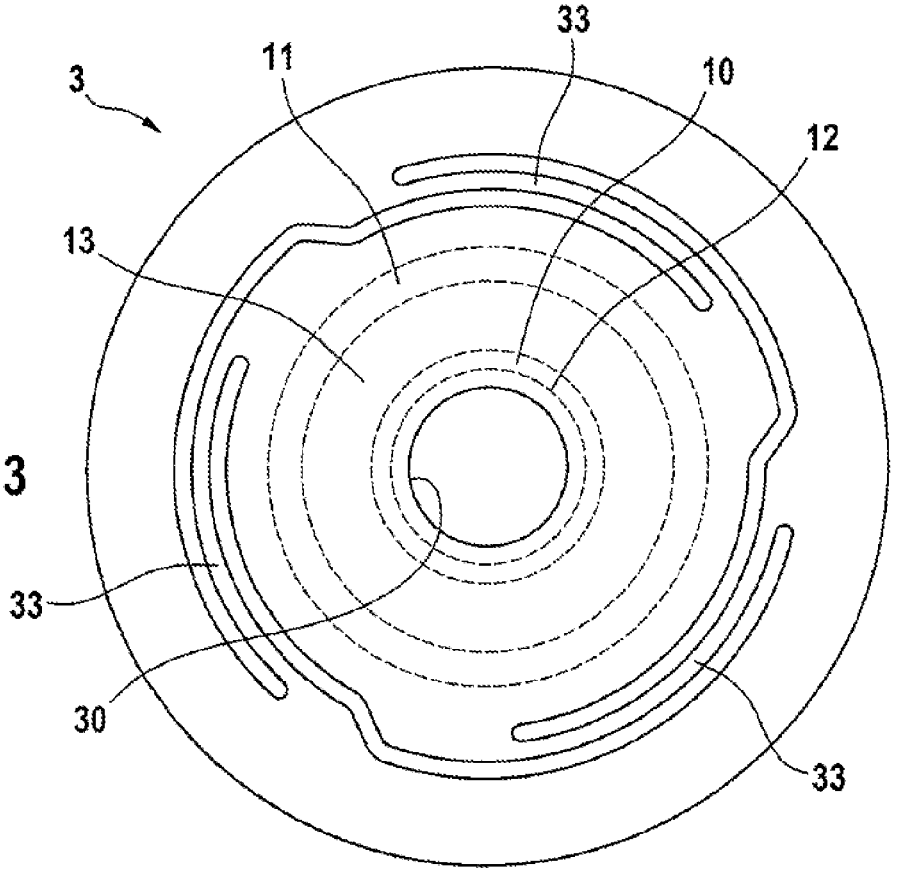
FIG. 3 shows a plan view of the diaphragm seal element shown in FIG. 2.

The fuel pump 1 furthermore comprises a diaphragm seal element 3, which is a disk-shaped element and is illustrated in detail in FIGS. 2 and 3. The diaphragm seal element 3 comprises a retaining region 31, which is formed in a ring shape at the outer circumference of the diaphragm seal element. The diaphragm seal element 3 furthermore comprises a sealing region 32, which is surrounded by the retaining region 31. Formed between the sealing region 32 and the retaining region 31 are three spring arms 33, which connect the retaining region 31 resiliently to the sealing region 32. A delivery opening 30 is furthermore formed centrally in the middle of the diaphragm seal element 3.

Figure 1:
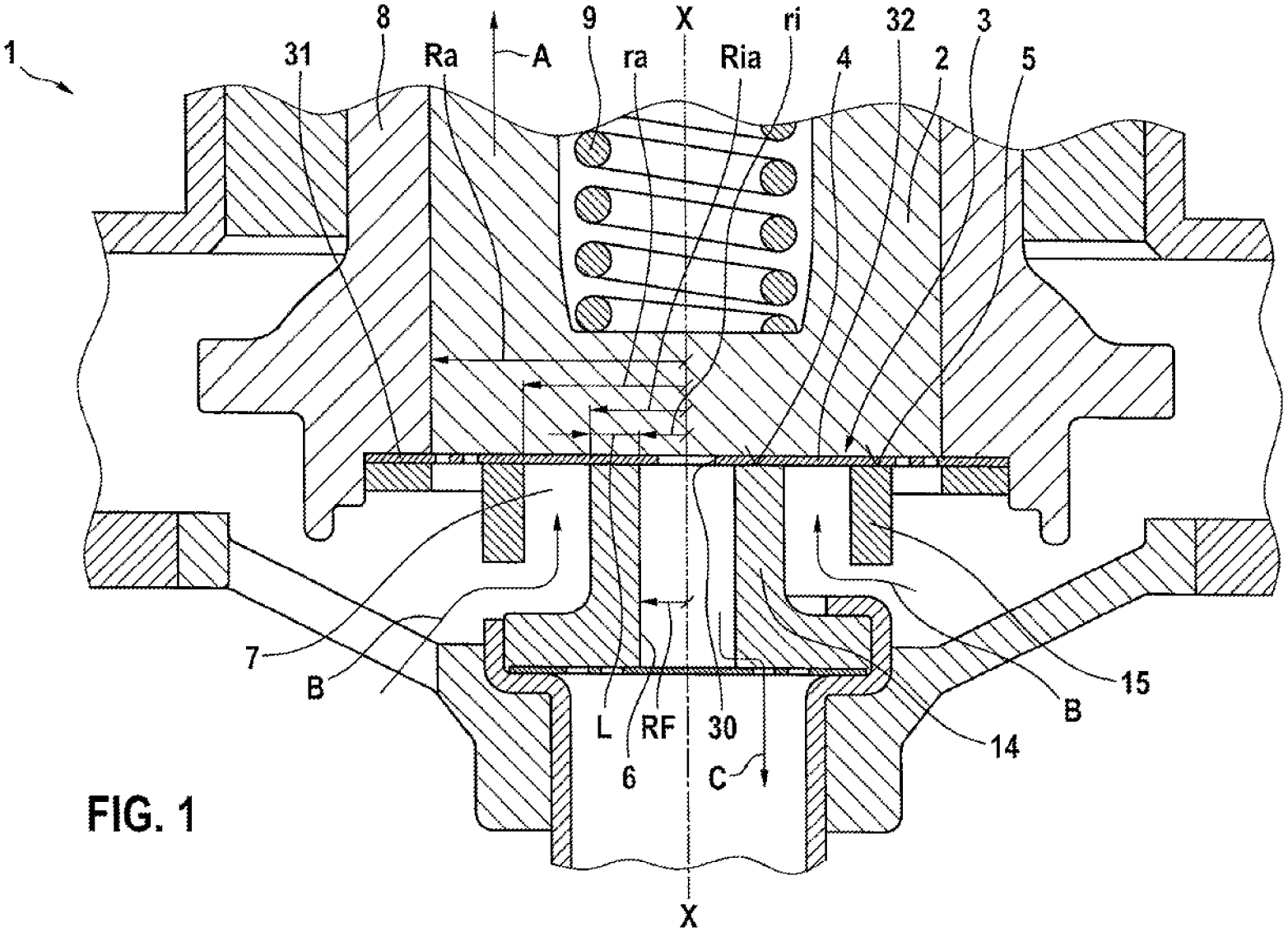
FIG. 1 shows a schematic section through a fuel pump according to a preferred illustrative embodiment of the invention.

As can be seen, in particular from FIG. 1, the fuel pump 1 furthermore comprises an inner annular seal seat 4 and an outer annular seal seat 5.

Here, the inner seal seat 4 is formed between the diaphragm seal element 3 and a bushing 14. The outer seal seat 5 is formed between the diaphragm seal element 3 and a sleeve 15. In this case, the bushing 14 is arranged within the sleeve 15 (cf. FIG. 1). As a result, an annular feed region 7, via which fuel is drawn in, is formed between the bushing 14 and the sleeve 15.

A delivery passage 6, through which the pressurized fuel is delivered, is furthermore provided in the bushing 14.

Here, the fuel pump 1 according to the invention operates as follows. For intake, the piston 2 is moved in the direction of arrow A counter to the spring force of the spring element 9. The diaphragm seal element 3 is thereby also moved in the direction of arrow A since a reduced pressure is produced in the region of the piston head. As a result, the diaphragm seal element 3 rises simultaneously from the inner seal seat 4 and from the outer seal seat 5.

As a result, fuel is then drawn in via the feed region 7 into the pressure chamber which is forming, as indicated by arrow B in FIG. 1. Here, a speed with which the fuel flows past the inner seal seat 4 and the outer seal seat 5 is equal. As a result, identical pressure conditions are maintained in the region of both seal seats 4, 5 during the intake process. In this way, it is possible to prevent gases from evaporating from the fuel, even if the fuel is at a predetermined high temperature.

Once the top end position is reached, the direction of motion of the piston 2 is reversed, with the result that the piston is moved back in the direction of the bushing 14 again. As a result, fuel is delivered through the delivery opening 30, which is provided in the diaphragm seal element 3, into the cylindrical passage 6 formed in the bushing 14. This is indicated by arrow C in FIG. 1.

According to the invention, a pressure drop in the region of the two seal seats 4, 5 can thus be reduced.

By virtue of the embodiment of the diaphragm seal element 3 with the spring arms 33, the diaphragm seal element 3 itself has a spring rate. This spring rate is chosen so that the hydraulic forces allow a stroke which is as large as possible. As a particular preference, the diaphragm seal element 3 adheres to the piston head 2 during the intake process.

The components of the fuel pump furthermore satisfy the following equation:

$$(Ra^2-ra^2)/(ri+L)^2=ra/ri.$$

Here, ri is an inner radius of the inner seal seat 4, ra is an inner radius of the outer seal seat 5, Ra is a radius of the piston 2 and L is a difference between an outer radius Ria of the inner seal seat 4 and the inner radius ri of the inner seal seat 4.

Here, the length L at the inner seal seat 4 between the diaphragm seal element 3 and the bushing 14 is chosen in such a way that this is embodied to be as small as possible in order to enlarge the inner radius ri of the inner seal seat 4 (cf. FIGS. 2 and 3). Here, the inner radius ra of the outer seal seat 5 is chosen to be as large as possible. In this case, a sum of an area 11 of the outer seal seat 5 and an area 10 of the inner seal seat 4 is larger than an area 13 of the annular feed region 7.

A radius RF of the delivery passage 6 in the bushing 14 is furthermore equal to the inner radius ri at the inner seal seat 4. In this case, the delivery opening 30 has a smaller area than a cross-sectional area 12 of the delivery passage 6 (cf. FIG. 1).

It is thus possible, according to the invention, to ensure a significantly improved delivery characteristic, especially in the case of hot fuel. According to the invention, a situation where gases are released from the fuel during the intake process and collect in an unwanted way at the piston 2, thereby significantly reducing the delivery rate of the fuel pump, is furthermore avoided.

The invention claimed is:

1. A fuel pump for delivering fuel, the fuel pump comprising:

a piston (2) having a centerline (X), and a diaphragm seal element (3) that contacts an inner annular seal seat (4) and an outer annular seal seat (5) in a sealing manner when the piston is in a first position, wherein a centerline of the inner annular seal seat (4) and a centerline of the outer annular seal seat (5) coincide with the centerline of the piston (X), wherein components of the fuel pump satisfy an equation, wherein the equation is:

$$(Ra^2-ra^2)/(ri+L)^2=ra/ri,$$

wherein ri is an inner radius of the inner annular seal seat (4) measured from the centerline of the piston (X), wherein ra is an inner radius of the outer annular seal seat (5) measured from the centerline of the piston (X), wherein Ra is a radius of the piston (2) measured from the centerline of the piston (X) to an outer circumference of the piston, wherein L is a difference between an outer radius (Ria) of the inner annular seal seat (4) measured from the centerline of the piston (X) and the inner radius (ri) of the inner annular seal seat (4), and wherein the piston (2) is configured to move from the first position and away from the diaphragm seal element (3) to create a region of low pressure to move the diaphragm seal element (3) away from the inner annular seal seat (4) and away from the outer annular seal seat (5).

2. The pump as claimed in claim 1, characterized in that the diaphragm seal element (3) has a central circular delivery opening (30).

3. The pump as claimed in claim 1, characterized in that the diaphragm seal element (3) has an outer retaining region (31) and an inner sealing region (32), which are connected to one another by connecting arms (33).

4. The pump as claimed in claim 2, further comprising a delivery passage (6) into which the pump delivers, the delivery passage (6) positioned within the inner annular seal seat (4), wherein a diameter of the delivery passage (6) is measured perpendicularly to the centerline of the piston (X) and is greater than a diameter of the central circular delivery opening (30) measured perpendicularly to the centerline of the piston (X).

5. The pump as claimed in claim 4, characterized in that the inner radius (ri) of the inner annular seal seat (4) is equal to a radius of the delivery passage (6).

6. The pump as claimed in claim 1, comprising a feed region (7) positioned between the inner annular seal seat (4) and the outer annular seal seat (5), and having an annular cross section.

7. The pump as claimed in claim 6, characterized in that an area of the annular cross section of the feed region (7) measured perpendicularly to the centerline of the piston (X)

is larger than a sum of: (i) a first contact area (10) between the inner seal seat (4) and the diaphragm seal element (3) and (ii) a second contact area (11) between the outer seal seat (5) and the diaphragm seal element (3).

8. The pump as claimed in claim 1, characterized in that the diaphragm seal element (3) has an outer retaining region (31) and an inner sealing region (32), which are connected to one another by spring arms.

9. The pump as claimed in claim 1, further comprising a bushing (14) forming the inner annular seal seat (4), a sleeve (15) forming the outer annular seal seat (5), and a feed region (7) defined between the inner annular seal seat (4) and the outer annular seal seat (5), wherein a delivery passage (6) into which the pump delivers is positioned within the inner annular seal seat (4), and wherein, when the piston moves away from the diaphragm seal element (3), the feed region (7) is fluidly connected to the delivery passage (6).

10. The pump as claimed in claim 9, wherein the piston is movable within a cylinder (8), wherein the diaphragm seal element (3) has an outer retaining region (31) which is formed in a ring shape at an outer circumference of the diaphragm seal element (3), and wherein the outer retaining region (31) abuts the cylinder (8).

11. The pump as claimed in claim 1, wherein the diaphragm seal element (3) abuts the inner annular seal seat (4), the outer annular seal seat (5), and the piston when the piston is in the first position.

* * * * *